US009157622B2

(12) United States Patent
Yanping

(10) Patent No.: US 9,157,622 B2
(45) Date of Patent: Oct. 13, 2015

(54) LINEAR LED LIGHT WITH ROTATIONAL MOUNT

(71) Applicant: Cledlight Semiconductor Lighting Co., Ltd., Longhua, Shenzhen (CN)

(72) Inventor: Liu Yanping, Shenzhen (CN)

(73) Assignee: Cledlight Semiconductor Lighting Co., Ltd., Shenzhen (CN)

( * ) Notice: Subject to any disclaimer, the term of this patent is extended or adjusted under 35 U.S.C. 154(b) by 107 days.

(21) Appl. No.: 13/961,247

(22) Filed: Aug. 7, 2013

(65) Prior Publication Data

US 2014/0268724 A1 Sep. 18, 2014

(30) Foreign Application Priority Data

Mar. 14, 2013 (CA) ..... 2809709

(51) Int. Cl.

| | |
|---|---|
| ***F21V 21/30*** | (2006.01) |
| ***F21V 21/02*** | (2006.01) |
| *F21V 21/005* | (2006.01) |
| *F21V 5/04* | (2006.01) |
| *F21S 4/00* | (2006.01) |
| *F21S 8/04* | (2006.01) |
| *F21Y 101/02* | (2006.01) |
| *F21Y 103/00* | (2006.01) |

(52) U.S. Cl.

CPC ..... *F21V 21/30* (2013.01); *F21V 21/025* (2013.01); *F21S 4/008* (2013.01); *F21S 8/04* (2013.01); *F21V 5/04* (2013.01); *F21V 21/005* (2013.01); *F21Y 2101/02* (2013.01); *F21Y 2103/003* (2013.01)

(58) Field of Classification Search

CPC ..... F21S 4/008; F21V 17/02; F21V 17/107; F21V 21/14; F21V 21/30; F16M 13/022; F16C 11/04

USPC ..... 16/267, 268, 269, 254, 260, 261, 337, 16/342, 344, 343, 347

See application file for complete search history.

(56) References Cited

U.S. PATENT DOCUMENTS

| | | | | |
|---|---|---|---|---|
| 3,250,909 | A * | 5/1966 | Oldenburger | 362/205 |
| 3,263,069 | A * | 7/1966 | Krucki et al. | 362/431 |
| 3,275,823 | A * | 9/1966 | Zimmerman et al. | 362/477 |
| 3,854,166 | A * | 12/1974 | Hannes | 16/260 |
| 4,185,410 | A * | 1/1980 | Kristiansen | 446/104 |
| 4,665,585 | A * | 5/1987 | Westin | 16/267 |
| 4,776,553 | A * | 10/1988 | Kobayashi | 248/558 |
| 4,942,271 | A * | 7/1990 | Corsi et al. | 16/267 |
| 4,974,130 | A * | 11/1990 | Friedman | 362/199 |
| D397,480 | S | 8/1998 | Herst et al. | |
| 5,893,630 | A * | 4/1999 | Mosquera | 362/191 |
| 6,193,394 | B1 | 2/2001 | Herst et al. | |
| 6,984,054 | B2 * | 1/2006 | Lai | 362/199 |
| D543,651 | S | 5/2007 | Hargreaves | |

(Continued)

FOREIGN PATENT DOCUMENTS

| | | | | |
|---|---|---|---|---|
| EP | 434414 | A1 * | 6/1991 | E05D 1/06 |

*Primary Examiner* — Ismael Negron

(74) *Attorney, Agent, or Firm* — Maine Cernota & Rardin

(57) ABSTRACT

An LED linear light with a rotational mounting including a base plate adapted for attachment to a surface and a rotating connection member. The rotating connection member is attached to the base plate by a hinge means to permit rotation of the rotating connection member relative to the base plate. When attached to the housing of the LED linear light, rotation of the rotating connection member relative to the base plate, the illumination direction of the LED linear light is changed.

16 Claims, 6 Drawing Sheets

(56) References Cited

U.S. PATENT DOCUMENTS

| | | | | |
|---|---|---|---|---|
| D565,515 | S | 4/2008 | Chen | |
| D572,400 | S | 7/2008 | Benensohn | |
| D580,087 | S | 11/2008 | Couture et al. | |
| D586,029 | S | 2/2009 | Copeland | |
| D586,492 | S | 2/2009 | Copeland | |
| D592,785 | S | 5/2009 | Bisberg et al. | |
| D595,444 | S | 6/2009 | Shimomura | |
| D607,598 | S | 1/2010 | Xiao et al. | |
| D615,236 | S | 5/2010 | Beghelli | |
| D617,935 | S | 6/2010 | Miletich et al. | |
| 7,731,386 | B2 * | 6/2010 | Levine | 362/197 |
| D626,267 | S | 10/2010 | Ng | |
| D627,914 | S | 11/2010 | Couture | |
| D642,326 | S | 7/2011 | Leadford et al. | |
| 8,025,418 | B2 * | 9/2011 | Zick | 362/20 |
| 8,206,002 | B1 | 6/2012 | Olson | |
| D690,839 | S | 10/2013 | Wang | |
| 8,752,247 | B2 * | 6/2014 | Franchini | 16/334 |
| 2005/0018435 | A1 * | 1/2005 | Selkee et al. | 362/427 |
| 2011/0058374 | A1 * | 3/2011 | Tsai et al. | 362/249.11 |
| 2011/0211330 | A1 * | 9/2011 | Wang | 362/20 |
| 2013/0229795 | A1 | 9/2013 | Wang et al. | |

* cited by examiner

LINEAR LED LIGHT WITH ROTATIONAL MOUNT

RELATED APPLICATIONS

This application claims priority to Canadian patent application no. 2809709 filed on Mar. 14, 2013. This application is herein incorporated by reference in its entirety for all purposes.

FIELD OF THE INVENTION

This invention generally relates to a mounting device suitable for use with a linear LED light having application in showcases, display cases or furniture.

BACKGROUND OF THE INVENTION

A light-emitting diode (LED) is a semiconductor light source. Since the first LED was developed in the 1960's, the technology has grown exponentially to today where LED's are increasingly being used commercially as replacements for incandescent, high intensity discharge (HID) and compact fluorescent (CFL) lights due to their long life and lower energy consumption.

In LED linear lights, the LEDs are arranged in a linear array fixed in a housing suitable for surface, recessed or pendant mounting with the illumination by the LEDs in a fixed orientation.

SUMMARY OF THE INVENTION

One embodiment of the present invention provides apparatus for a rotational mounting for a LED linear light, the rotational mounting comprising a base plate adapted for attachment to a surface and a rotating connection member. The rotating connection member is attached to the base plate by a hinge means to permit rotation of the rotating connection member relative to the base plate.

In one embodiment, the base plate has a plate portion with a first end and a second end and a top surface and bottom surface. A latch lug is provided on the bottom surface of the plate portion. The latch lug depends from the first end of the plate portion. A first hinge member on the bottom surface of the plate portion depends from the second end of the plate portion. The rotating connection member has top and bottom surfaces and a first end and second end with a recessed portion formed in the top surface sized and shaped to correspond to the profile of the bottom surface of the base plate.

In another aspect a LED linear light is provided comprising an elongated housing, a LED light module installed in the housing, a lens cover overlaying the LED light module when installed in the housing and a rotational mounting provided at opposite ends of the housing. The rotational mounting has a base plate adapted for attachment to a surface and a rotating connection member. The rotating connection member is connected to the housing of the LED linear light and attached to the base plate by a hinge means to permit rotation of the rotating connection member and housing relative to the base plate.

Further features of the invention will be described or will become apparent in the course of the following detailed description.

BRIEF DESCRIPTION OF THE DRAWINGS

In order that the invention may be more clearly understood, an embodiment thereof will now be described in detail by way of example, with reference to the accompanying drawings, in which.

DETAILED DESCRIPTION

Referring to FIGS. 1 to 4, one embodiment of a rotational mounting suitable for use with linear lighting and particularly LED linear lights according to the present invention is illustrated.

Figure 1:
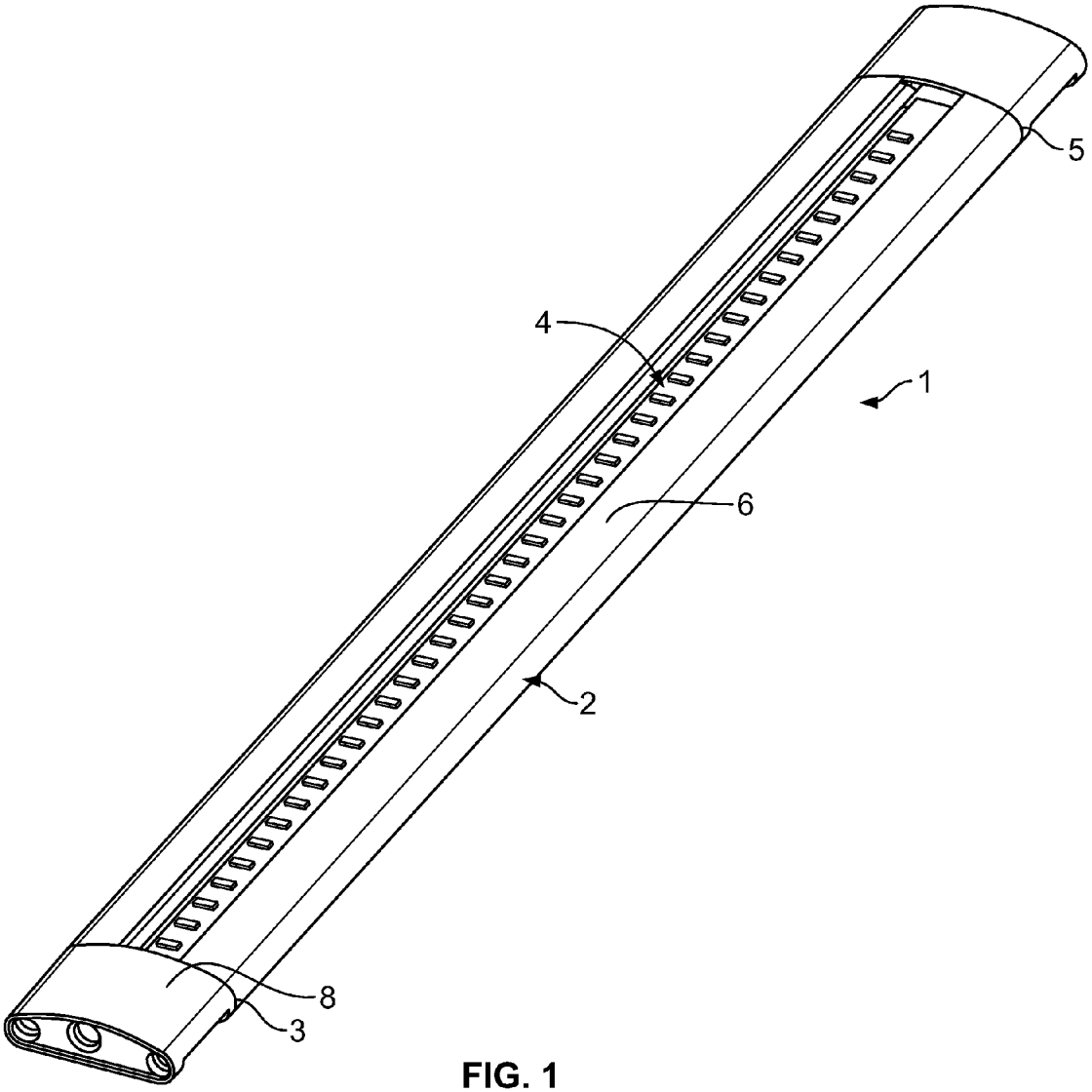
FIG. 1 is a perspective view of a LED linear light having a rotational mounting according to the present invention at each end of the LED linear light.
Figure 2:
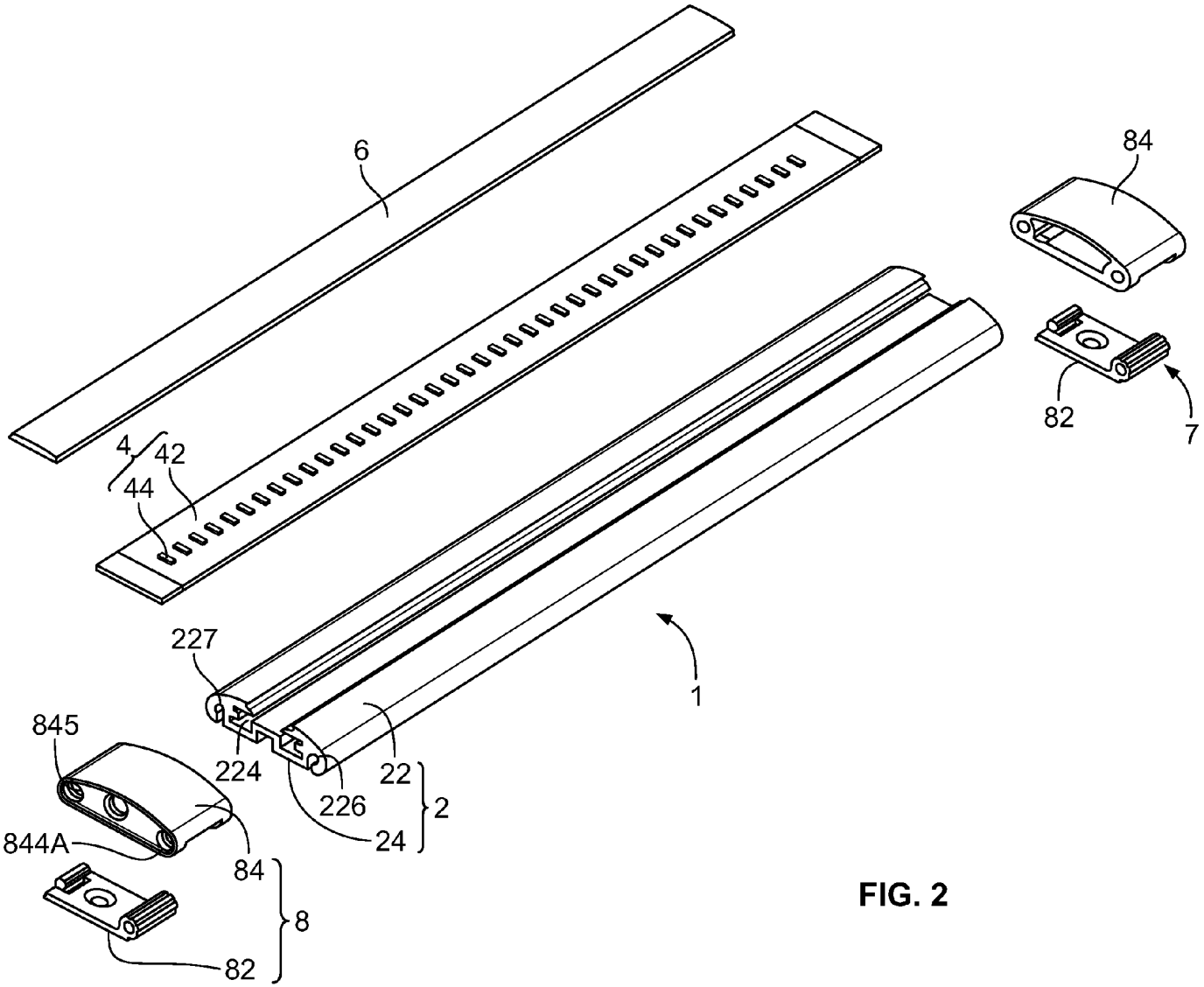
FIG. 2 is a perspective assembly drawing for the LED linear light and rotational mountings of FIG. 1.

In FIGS. 1 and 2, one type of LED linear light 1 is generally illustrated which includes an elongated housing 2, LED light module 4 which is installed in housing 2 and lens cover 6 to overlay the LED light module 4 when installed in the housing 2. The said LED light module 4 includes substrate 42 and several LED luminous units 44 electrically installed on the substrate. In the embodiment illustrated the said housing 2 is an extruded metal shape with a bottom surface 22 and top surface 24. The LED light module 4 is intended to be retained within longitudinal recess 224 and lens cover 6 fits in place over the LED light module 4. The housing 2 is preferably made from aluminum alloy material and the said lens cover body 6 is made from plastic material that will permit light from the LED to be dispersed through the lens cover 6.

One embodiment of a rotational mounting, generally indicated at 8, is provided at opposite ends 3, 5 of the housing 2. The rotational mounting 8 comprises a base plate 82 and rotating connection member 84. The rotating connection member 84 is attached to one of the opposite ends 3 or 5 of housing 2 and to base plate 82 by a hinge means 7.

Figure 3:
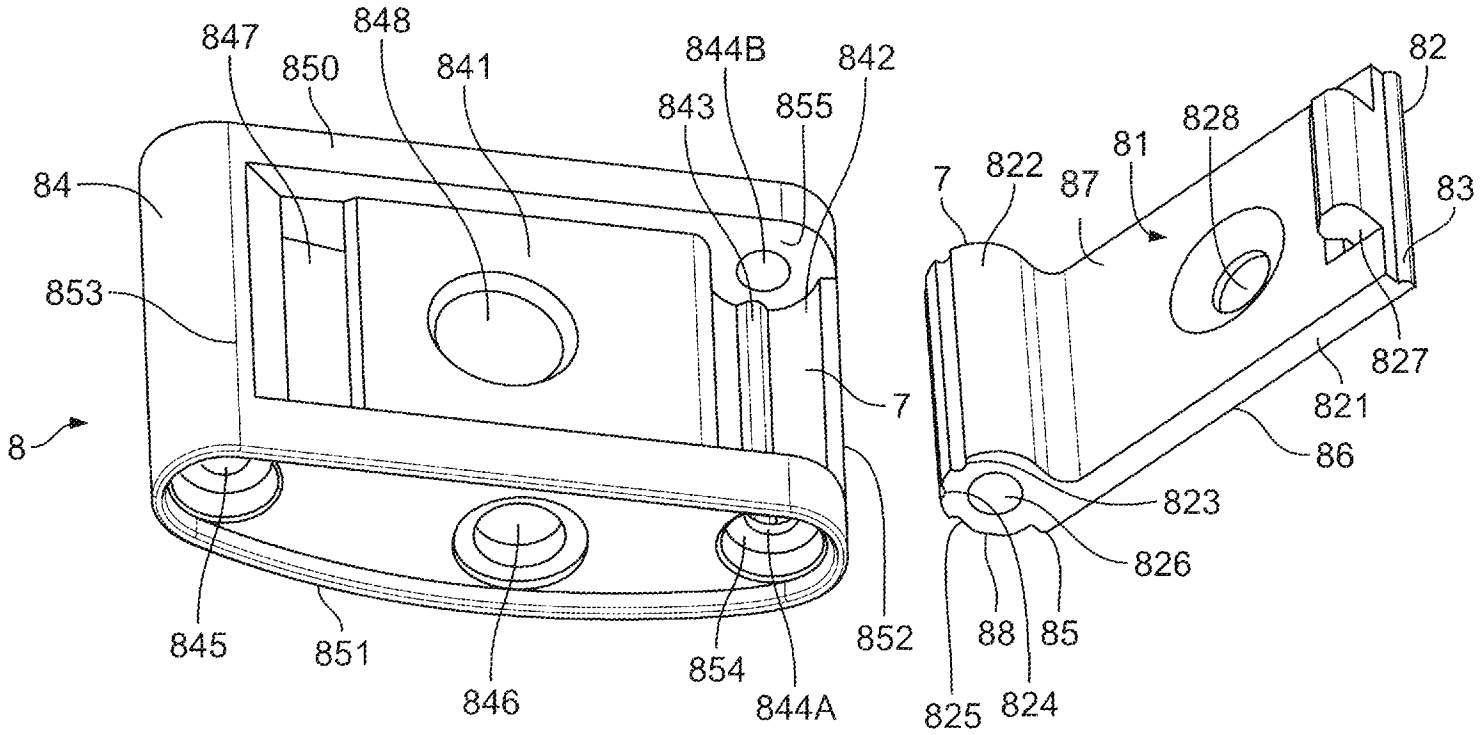
FIG. 3 is an enlarged perspective view of an assembly drawing for a rotational mounting according to the present invention having a base plate and rotating connection member.
Figure 4:
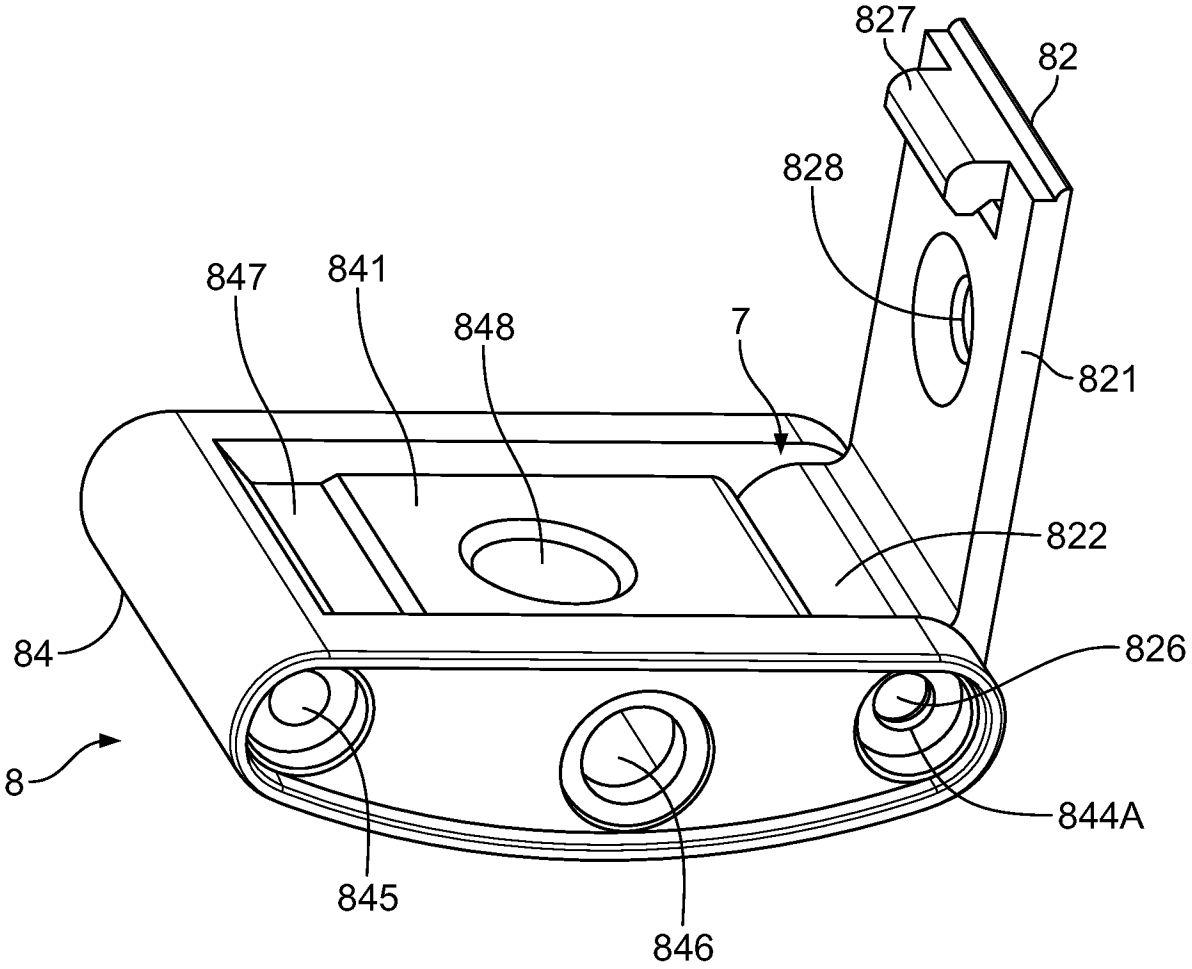
FIG. 4 is an enlarged perspective view of the rotational mounting of FIG. 3.

FIGS. 3 and 4 show the structure of the rotational mounting 8 in greater detail. The base plate 82 has a plate portion 821 with first end 83 and second end 85 and a top surface 86 and bottom surface 87. A latch lug 827 on the bottom surface 87 of plate portion 821 depends from the first end 83 of plate portion 81. A first hinge member 822 on the bottom surface 87 of plate portion 821 depends from the second end 85 of plate portion 821. A shaft hole 826 is provided longitudinally through the first hinge member 822. At least one longitudinal groove is provided on the outer surface 88 of the first hinge member 822. In the embodiment illustrated three grooves 823, 824 and 824 are illustrated but a greater or lesser number of grooves can be provided. A mounting hole 828 in the plate portion 821 enables the base plate 82 to be affixed by screws or other suitable fasteners to a vertical or horizontal surface.

The rotating connection member 84 has top or top surface 850 and bottom or bottom surface 851 surfaces and a first end 852 and second end 853. A recessed portion 841 is formed in the top surface 850 sized and shaped correspond to the profile of the bottom surface 87 of the base plate 82 including latch lug 827 and first hinge member 822. In the embodiment illustrated the recessed portion 841 has a first groove section or groove 842 with end walls 854, 855 is formed across the end of the recessed portion 841 adjacent the first end 852 of rotating connection member 84 sized and shaped to accommodate the first hinge member 822 on the base plate 82. Holes 844A and 844B in the end walls 854,855 of groove section 842 are located to align with the shaft hole 826 in the first hinge member 822 when it is inserted into groove section 842. A longitudinal rib 843 at the bottom of groove section 842 is adapted to fit into the longitudinal grooves 823, 824, 825 on the hinge member 822 in the manner described below.

A second recessed section 847 is located across the opposite end of the recessed portion 841 adjacent the second end 853 of rotating connection member 84 sized and shaped to accommodate the latch lug 827 on the base plate 82.

The base plate 82 and rotating connection member 84 are connected by inserting the base plate 82 into the recessed portion 841 on the top surface 850 of the rotating connection member 84 with the first hinge member 822 in groove 842 and latch lug 827 in the second recessed portion 847. The rotating connection member 84 can then be connected to the end of housing 2 by bolts or screws through holes 845, 844A and 844B. The screw or bolt through holes 844A and 844B also passes through the shaft hole 826 in the first hinge member 822 thereby creating hinge means 7. The rotating connection member 84 can be rotated relative to the base plate 82 through at least 90°. As the rotating connection member 84 is rotated rib 843 fits into one of grooves 824 or 825 to act as a stop to the angle of rotation preferably at first 45° when rib 843 fits it groove 824 and then 90° when rib 843 fits it groove 825.

A rotating mount or rotational mounting 8, with the base plate 82 located within the recessed portion 841 on rotating connection member 84, is connected to each end of housing 2 after the LED light module 4 and lens cover 6 are inserted into the housing 2, with the bottom surface 851 of the rotating connection member 84 aligned with the bottom surface 22 of housing 2. Screws, bolts or other suitable fastener are inserted through holes 845 and 844A, B into corresponding slots 226, 227 in the end of housing 2. As noted above, the screw or bolt through holes 844A and 844B also passes through bolt hole or shaft hole 826 in the first hinge member 822. In a first closed position the latch lug 827 on the base plate 82 fits into the second recessed portion 847 on the rotating connection member 84 and rib 843 fits into the groove 823 on the first hinge member 822. In this position the linear light is positioned to shine perpendicular to the surface to which base plate 82 is mounted. By unlatching the latch lug 827 on each rotating mount 8, the linear light can be rotated to shine at different angles (see FIG. 7).

Another hole 846 in the side of each rotating mount 8 permits the electrical components that link the LED light module 4 and an external power supply. As noted earlier screws 829 (see FIGS. 5 and 6) through the hole 828 on each base plate 82 attach the linear light to a ceiling, wall or other surface. A hole 848 in recessed portion 841 on rotating connection member 84 is aligned with the hole 828 in base plate 82 to accommodate a protruding screw head, if any, when the rotating mount 8 is affixed to a surface and insure the base plate 82 and rotating connection member 84 can be fully closed.

Figure 5:
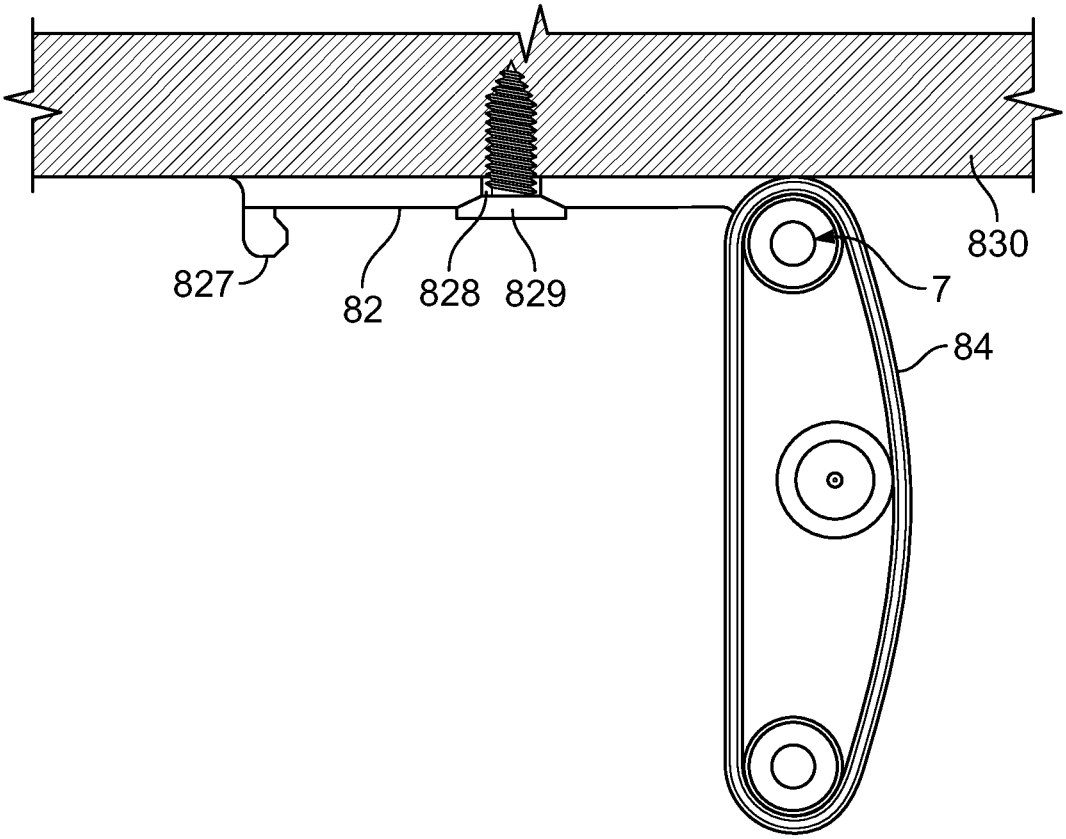
FIG. 5 is a cross-section view of the rotational mounting attached to a horizontal surface with the rotating connection member rotated at 90° to the base plate.
Figure 6:
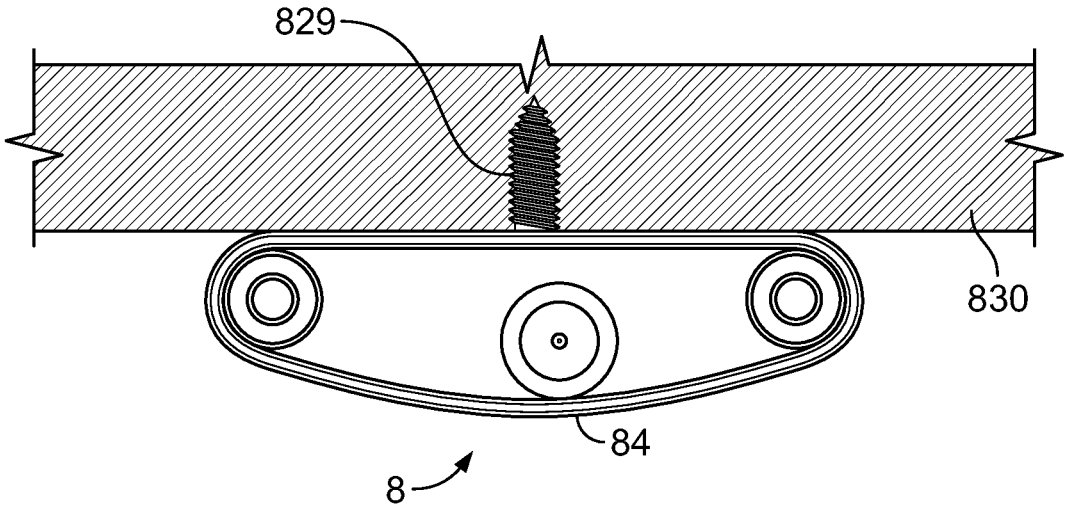
FIG. 6 is a cross-section view of the rotational mounting shown in FIG. 5 with the rotating connection member rotated to a closed position relative to the base plate.

FIGS. 5 and 6 show the mounting of the rotating mount to the underside of a horizontal surface 830.

Figure 7:
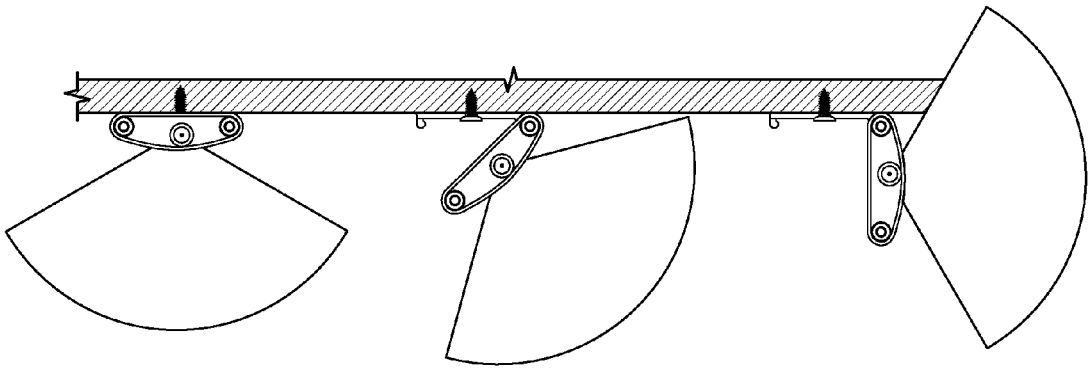
FIG. 7 illustrates schematically the rotational mounting of the present invention with the rotating connection member rotated at various angles to the base plate showing the different illumination orientation obtained.

FIG. 7 shows the change in the direction of illumination by movement of the rotating connection member through different angles of rotation from 0° to 45° and then to 90°.

Figure 8:
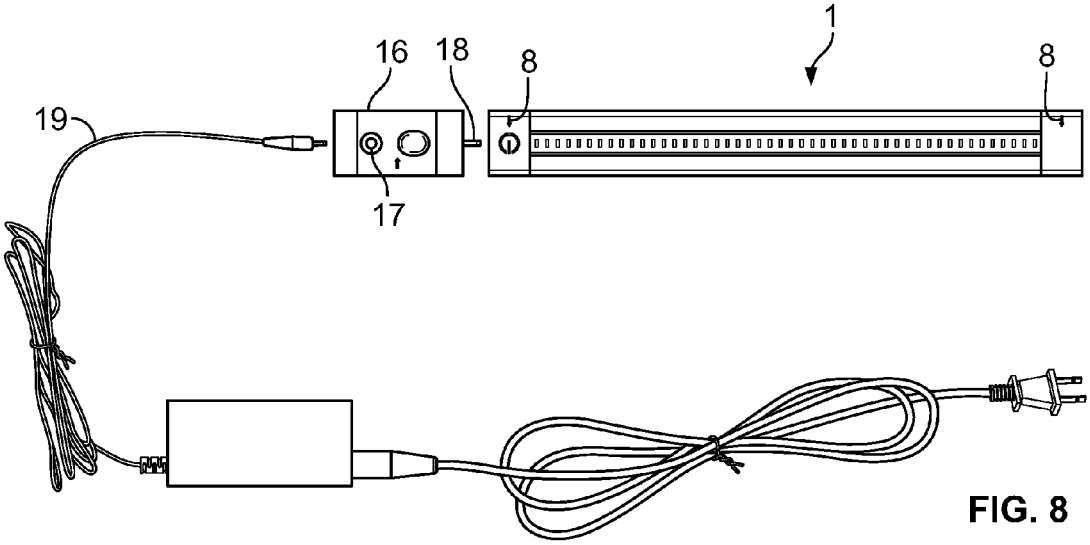
FIG. 8 shows a LED linear lighting fixture according to the present invention together with accompanying electrical components.

FIG. 8 illustrates a LED linear lighting fixture 1 according to the present invention together with accompanying electrical components. A pir (passive infrared sensor) sensor 16 equipped with an on/off button 17 connects by connection 18 through hole 846 in the side of one rotating mount 8 permits the electrical components that link the LED linear lighting fixture and an external power cord 19 for connection to the power supply.

Figure 9:
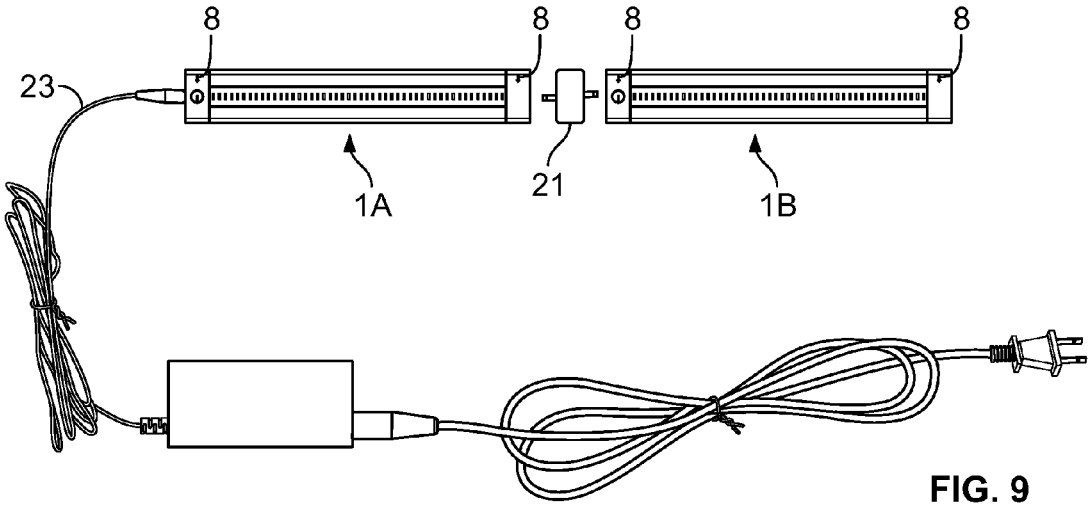
FIG. 9 shows two LED linear lighting fixtures connected in series with the rotational mounting according to the present invention.

FIG. 9 illustrates a pair of LED linear lighting fixtures 1A, 1B joined by connector 21 with and having a power cord 23 for connection to the power supply.

In conclusion, beneficial effect of this invention, it provide a kind of LED linear light which by the light is mounted to permit rotation to change the orientation of the LED module to change the lighting direction of the LED linear light. It is easy to use. Its integral structure is simple, reasonable and easy to make and with high practical applicability thus can be applied to various LED lighting areas like commercial lighting and indoor lighting.

While the principles of the invention have been shown and described in connection with specific embodiments, it is to be understood that such embodiments are by way of example and are not limiting As is evident from the foregoing description, certain aspects of the present invention are not limited by the particular details of the mobile stand illustrated in the drawings. Other modifications and applications, or equivalents, will occur to those skilled in the art. The terms "having", "comprising" and "including" and similar terms as used in the foregoing specification are used in the sense of "optional" or "may include" and not as "required". Many changes, modifications, variations and other uses and applications of the present construction will, however, become apparent to those skilled in the art after considering the specification and attached drawings. All such changes, modifications, variations and other uses and applications which do not depart from the spirit and scope of the invention are deemed to be covered by the invention which is limited only by the claims that follow. The scope of the disclosure is not intended to be limited to the embodiments shown herein, but is to be accorded the full scope consistent with the claims, wherein reference to an element in the singular is not intended to mean "one and only one" unless specifically so stated, but rather one or more. All structural and functional equivalents to the elements of the embodiment described throughout the disclosure that are known or later come to be known to those of ordinary skill in the art are expressly incorporated herein by reference and intended to be encompassed by the claims.

I claim:

1. A rotational mounting for a LED linear light, the rotational mounting comprising: a base plate adapted for attachment to a surface; and a rotating connection member; wherein the rotating connection member is attached to the base plate by a hinge means to permit and limit rotation of the rotating connection member relative to the base plate; the base plate has a plate portion with first end and second end and a top surface and bottom surface; a latch lug on the bottom surface of plate portion depends from the first end of plate portion; the hinge means including a first hinge member on the bottom surface of plate portion depends from the second end of plate portion; a shaft hole is provided longitudinally through the first hinge member, and at least one longitudinal groove is provided on an outer surface of the first hinge member.

2. A rotational mounting for a LED linear light according to claim 1, the at least one longitudinal groove includes three longitudinal grooves.

3. A rotational mounting for a LED linear light according to claim 1, the base plate having a plate portion including a mounting hole in the plate portion for enabling the base plate to be affixed by fasteners to a surface.

4. A rotational mounting for a LED linear light according to claim 1, wherein the rotating connection member has top and bottom surfaces, and a first end and second end, with a recessed portion formed in the top surface sized and shaped correspond to the profile of the bottom surface of the base plate.

5. A rotational mounting for a LED linear light according to claim 4, wherein a second recessed section is located across the opposite end of the recessed portion adjacent the second end of the rotating connection member, and sized and shaped to accommodate a latch lug on the base plate.

6. A rotational mounting for a LED linear light according to claim 4, the hinge means including a first hinge member, wherein the recessed portion of the rotating connection member has a first groove section with end walls formed across the end of the recessed portion adjacent the first end of rotating connection member, the first grooved section sized and shaped to accommodate the first hinge member on the base plate.

7. A rotational mounting for a LED linear light according to claim 6, wherein a longitudinal rib at the bottom of the first groove section on the rotating connection member is adapted to fit into a plurality of longitudinal grooves formed on the first hinge member on the base plate.

8. A rotational mounting for a LED linear light according to claim 7, wherein holes are provided in end walls of the first groove section, and are located to align with the shaft hole in the first hinge member on the base plate when it is inserted into the first groove section.

9. A LED linear light comprising an elongated housing; an LED light module installed in the housing; and lens cover overlaying the LED light module when installed in the housing; and a rotational mounting provided at opposite ends of the housing; the rotational mounting comprising: a base plate adapted for attachment to a surface; and a rotating connection member; wherein the rotating connection member is attached to the base plate by a hinge means to permit and limit rotation of the rotating connection member relative to the base plate; the base plate has a plate portion with first end and second end and a top surface and bottom surface; a latch lug on the bottom surface of plate portion depends from the first end of plate portion; the hinge means including a first hinge member on the bottom surface of plate portion depends from the second end of plate portion; a shaft hole is provided longitudinally through the first hinge member, and at least one longitudinal groove is provided on an outer surface of the first hinge member.

10. A LED linear light according to claim 9, the at least one longitudinal groove includes three longitudinal grooves.

11. A LED linear light according to claim 9, the base plate having a plate portion including a mounting hole in the plate portion for enabling the base plate to be affixed by fasteners to a surface.

12. A LED linear light according to claim 9, wherein the rotating connection member has top and bottom surfaces, and a first end and second end, with a recessed portion formed in the top surface sized and shaped correspond to the profile of the bottom surface of the base plate.

13. A LED linear light according to claim 12, wherein a second recessed section is located across the opposite end of the recessed portion adjacent the second end of the rotating connection member, and sized and shaped to accommodate a latch lug on the base plate.

14. A LED linear light according to claim 12, the hinge means including a first hinge member, wherein the recessed portion of the rotating connection member has a first groove section with end walls formed across the end of the recessed portion adjacent the first end of rotating connection member, the first grooved section sized and shaped to accommodate the first hinge member on the base plate.

15. A LED linear light according to claim 14, wherein a longitudinal rib at the bottom of the first groove section on the rotating connection member is adapted to fit into a plurality of longitudinal grooves formed on the first hinge member on the base plate.

16. A LED linear light according to claim 15, wherein holes are provided in end walls of the first groove section, and are located to align with the shaft hole in the first hinge member on the base plate when it is inserted into the first groove section.

* * * * *